US010816297B1

(12) United States Patent
Williams et al.

(10) Patent No.: US 10,816,297 B1
(45) Date of Patent: Oct. 27, 2020

(54) BI-DIRECTIONAL TRIGGER ASSEMBLY

(71) Applicants: Clayton Williams, Dewey, AZ (US); William Randall, Cottonwood, AZ (US)

(72) Inventors: Clayton Williams, Dewey, AZ (US); William Randall, Cottonwood, AZ (US)

( * ) Notice: Subject to any disclaimer, the term of this patent is extended or adjusted under 35 U.S.C. 154(b) by 0 days.

(21) Appl. No.: 16/876,042

(22) Filed: May 16, 2020

(51) Int. Cl.
*F41A 17/46* (2006.01)
*F41A 19/46* (2006.01)
*F41A 19/10* (2006.01)

(52) U.S. Cl.
CPC ..... *F41A 17/46* (2013.01); *F41A 19/10* (2013.01); *F41A 19/46* (2013.01)

(58) Field of Classification Search
CPC ..... F41A 17/46; F41A 19/00; F41A 19/10; F41A 19/46
See application file for complete search history.

(56) References Cited

U.S. PATENT DOCUMENTS 8,820,211 B1 * 9/2014 Hawbaker ..... F41A 19/46 89/139
8,893,607 B2 * 11/2014 Audibert ..... F41A 19/12 89/136
9,046,313 B1 * 6/2015 Lutton ..... F41A 19/44
9,146,066 B1 * 9/2015 Cason ..... F41A 19/09
9,310,150 B1 * 4/2016 Geissele ..... F41A 19/10
9,719,744 B2 * 8/2017 Horch ..... F41A 19/16
9,952,013 B2 * 4/2018 Fellows ..... F41A 19/46
10,107,580 B2 * 10/2018 Fellows ..... F41A 19/43
10,317,158 B2 * 6/2019 Geissele ..... F41A 17/46
10,337,818 B1 * 7/2019 Sampson, Jr. ..... F41A 19/12
10,480,882 B2 * 11/2019 Fellows ..... F41A 19/43
10,488,134 B2 * 11/2019 Olson ..... F41A 17/56

* cited by examiner

*Primary Examiner* — Joshua T Semick
(74) *Attorney, Agent, or Firm* — Morgan Law Offices, PLC

(57) ABSTRACT

A bi-directional trigger assembly comprises a trigger having a first protrusion. A trigger bar having a slot is coupled to the trigger. A selector switch is positioned adjacent the rear end of the trigger bar. A disconnector is accommodated within the slot. A hammer is provided adjacent the front end of the trigger bar, wherein the hammer is configured for operable coupling to the trigger bar and the disconnector. A linkage is configured for fitment adjacent the trigger bar within the fire arm, wherein the linkage includes a second protrusion positioned adjacent a top edge of the trigger bar. The linkage further includes a third protrusion wherein the third protrusion abuts the first protrusion for displacing the linkage downward when a forward force is applied on the trigger, thereby causing the second protrusion to exert a downward acting force adjacent the front end of the trigger bar.

8 Claims, 8 Drawing Sheets

BI-DIRECTIONAL TRIGGER ASSEMBLY

TECHNICAL FIELD

The present disclosure relates generally to a trigger assembly for a firearm, and more particularly, to a trigger assembly configured for bidirectional operation.

BACKGROUND

A trigger assembly of a firearm, such as an AR-15, includes a group of linkages that the user of the firearm actuates for firing a round from the firearm. The trigger assembly includes a trigger, which is the component that is required to be pulled rearward for firing the round. It is essential for optimal performance of the trigger assembly that the action of pulling is easy and crisp to ensure accurate firing of the round. As mentioned, the conventional trigger assemblies are designed so that the trigger is pulled rearward for firing a round; this is done because the movement of the index finger to pull the trigger rearward is a natural movement of the index finger. It is to be noted, however, that for the index finger, pulling the trigger rearward is not the only convenient option for firing a round; pulling the trigger forward is a movement that is also not unnatural to the index finger.

SUMMARY

A bi-directional trigger assembly for a firearm is disclosed herein. The trigger assembly comprises a trigger having a first protrusion. A trigger bar is coupled to the trigger. The trigger bar has a front end and a rear end. The trigger bar also defines a slot. A selector switch is positioned adjacent the rear end of the trigger bar, wherein the selector switch is operably coupled to the trigger bar for allowing or disallowing a movement of the trigger bar. A disconnector is accommodated within the slot. A hammer is provided adjacent the front end of the trigger bar, wherein the hammer is configured for operable coupling to the trigger bar and the disconnector. A linkage is configured for fitment adjacent the trigger bar within the fire arm, wherein the linkage includes a second protrusion, wherein the linkage is so fitted adjacent the trigger bar that the second protrusion is positioned adjacent a top edge of the trigger bar. The linkage further includes a third protrusion extending inward toward the trigger, in an assembled configuration, wherein the third protrusion abuts the first protrusion for displacing the linkage downward when a forward force is applied on the trigger, thereby causing the second protrusion to exert a downward acting force adjacent the front end of the trigger bar.

DETAILED DESCRIPTION OF EXAMPLE EMBODIMENTS

Example embodiments of the disclosure now will be described more fully hereinafter with reference to the accompanying drawings, in which example embodiments are shown. The concepts discussed herein may, however, be embodied in many different forms and should not be construed as limited to the example embodiments set forth herein; rather, these embodiments are provided so that this disclosure will be thorough and complete, and will fully convey the scope to those of ordinary skill in the art. Like numbers refer to like elements but not necessarily the same or identical elements throughout.

Figure 1A:
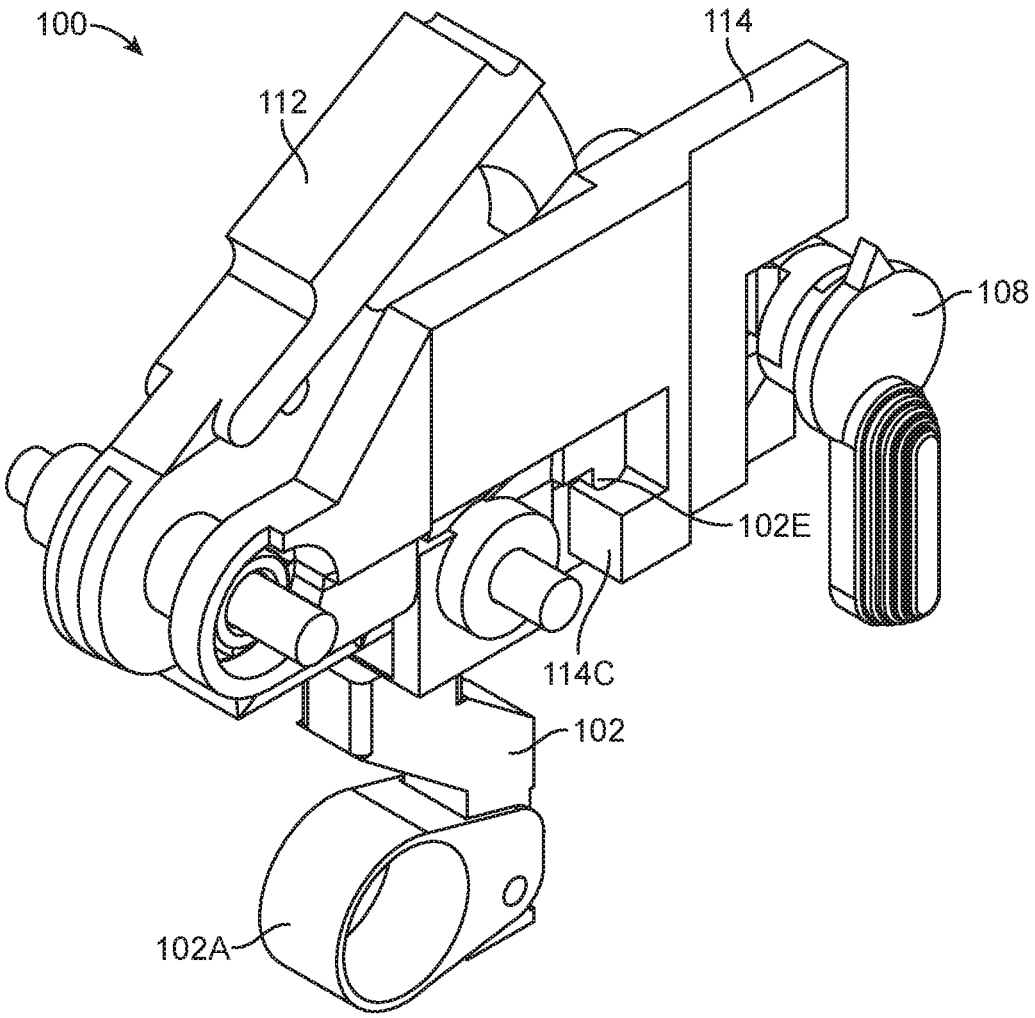
FIG. 1A shows a perspective view of a trigger assembly, according to an embodiment of the present disclosure.
Figure 1B:
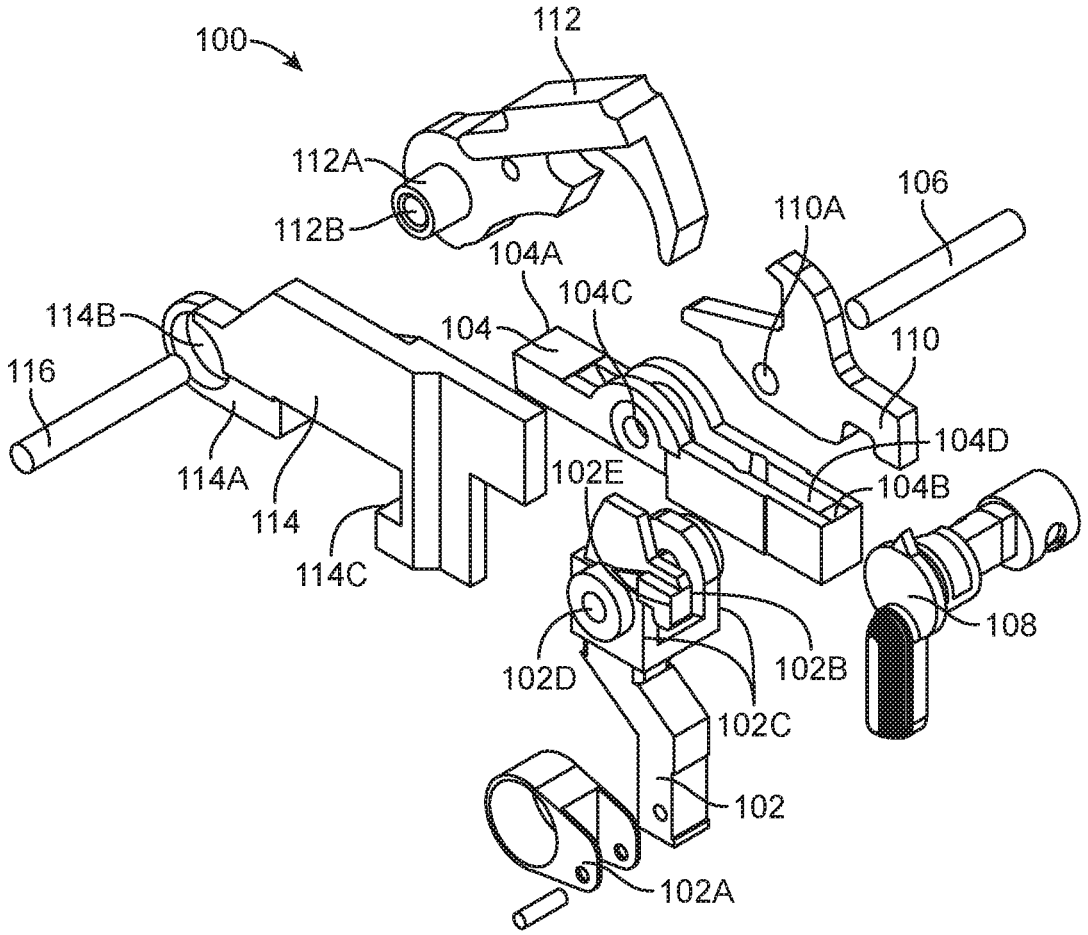
FIG. 1B shows an exploded view of the trigger assembly, according to an embodiment of the present disclosure.

Referring to FIG. 1A and FIG. 1B, perspective and exploded views of a trigger assembly 100, respectively, according to an embodiment of the present disclosure, are illustrated. The trigger assembly 100 comprises a trigger 102. The trigger 102, in accordance with an embodiment of the present disclosure, is the element of the trigger assembly 100 that may be pulled rearward or forward for firing a round from a firearm. The trigger 102 includes a finger loop 102A. The finger loop 102A allows a user to pull the trigger 102 either forward or rearward. As used in the present disclosure, forward direction refers to the direction pointing opposite the user of the firearm, while the rearward direction is the direction pointing towards the user of the firearm. The trigger 102 also includes a first protrusion 102E.

The trigger assembly 100 further includes a trigger bar 104 having a front end 104A and a rear end 104B. The trigger bar 104 is coupled to the trigger 102. More specifically, the trigger 102 comprises a slot 102B defined by a pair of flange plates 102C. The flange plates 102C include apertures 102D. The trigger bar 104 also includes apertures 104C. For coupling the trigger bar 104 with the trigger 102, the trigger bar 104 is disposed within the slot 102B such that the apertures 104C of the trigger bar 104 are aligned with the apertures 102D of the trigger 102. Once the apertures 102D, 104C are aligned, a pin 106 is used to couple the trigger 102 to the trigger bar 104.

The trigger assembly 100 further comprises a selector switch 108. The selector switch 108 is positioned adjacent the rear end 104B of the trigger bar 104, wherein the selector switch 108 is operably coupled to the trigger bar 104 for allowing or disallowing a movement of the trigger bar 104. The operation of the selector switch 108 is discussed in more elaboration in the subsequent sections of the present disclosure.

The trigger bar 104 further comprises a slot 104D. The slot 104D is an elongate slot substantially extending along an entire length of the trigger bar 104. The trigger assembly 100 further comprises a disconnector 110. The disconnector 110 also includes an aperture 110A. The disconnector 110 is accommodated within the slot 104D such that the aperture 110A is in alignment with the apertures 102D, 104C. The pin 106 then facilitates the coupling between the trigger 102, the trigger bar 104, and the disconnector 110 is facilitated by the pin 106.

The trigger assembly 100 further comprises a hammer 112. The hammer 112 is provided adjacent the front end 104A of the trigger bar 104. The hammer 112 is configured for operable coupling to the trigger bar 104 and the disconnector 110. The operation of the hammer 112 is discussed in more elaboration in the subsequent sections of the present disclosure.

The trigger assembly 100 further comprises a linkage 114. The linkage 114 includes a flanged extension 114A. The flanged extension 114A includes an aperture 114B. The hammer 112 includes a hollow cylindrical protrusion 112A extending from the hammer 112 and defining a through-hole 112B. The coupling between the hammer 112 and the linkage 114 is facilitated by inserting the hollow cylindrical protrusion 112A within the aperture 114B, and a pin 116 is inserted in the through-hole 112B. The linkage 114 is configured for fitment adjacent the trigger bar 104 within the fire arm.

Figure 4A:
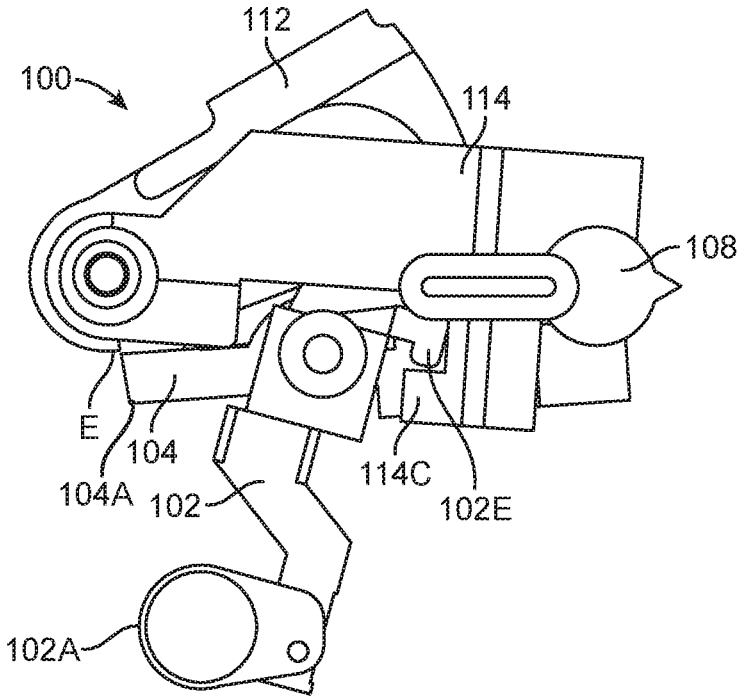
FIG. 4A thru FIG. 4D show side views of trigger assembly in different stages of third operative configuration thereof, according to an embodiment of the present disclosure.
Figure 4B:
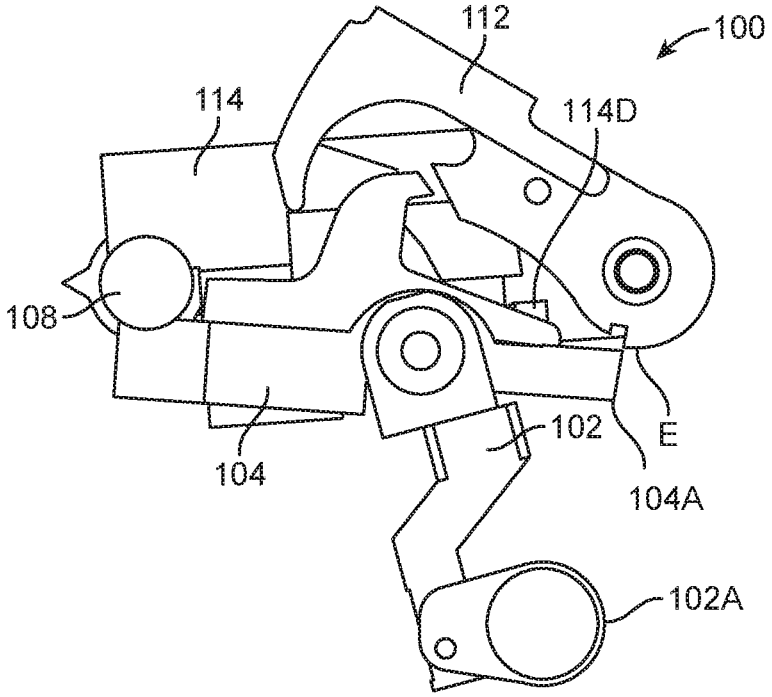
Figure 4C:
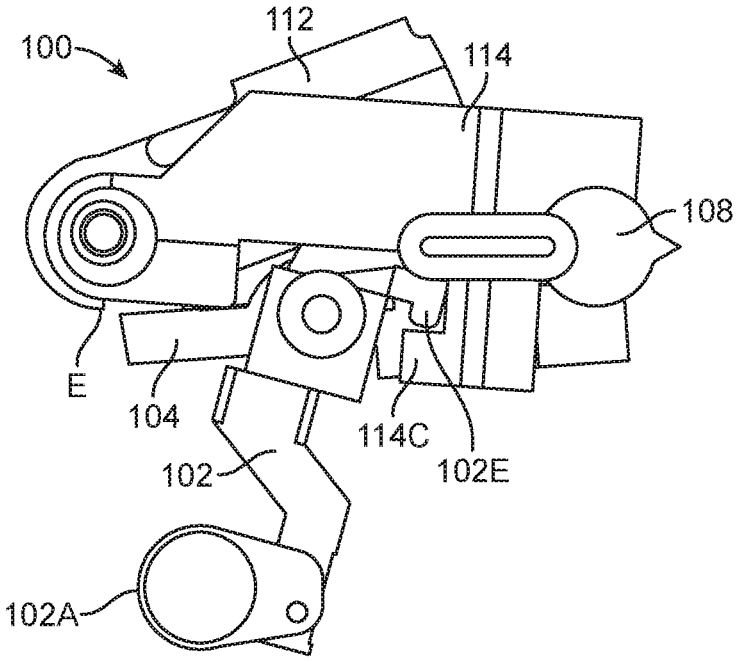
Figure 4D:
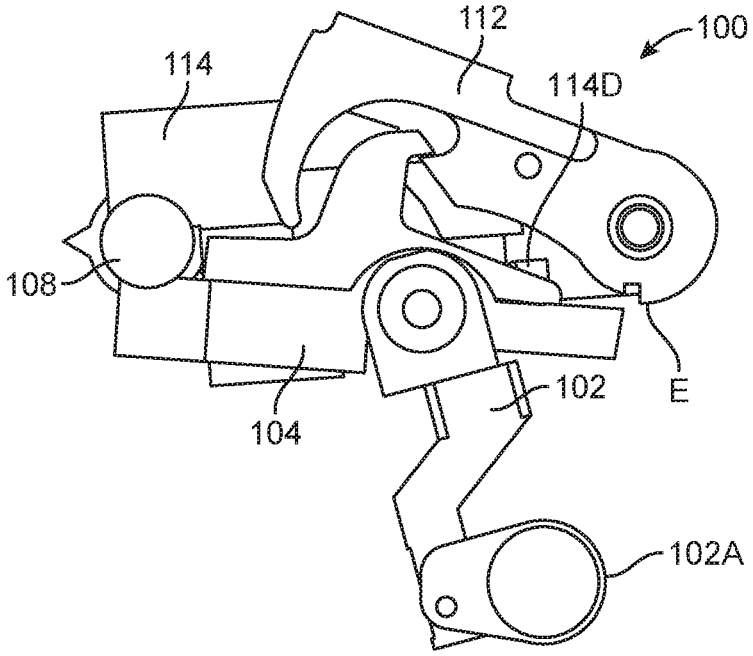

In accordance with an embodiment of the present disclosure, the linkage 114 includes a second protrusion 114D (as seen in FIGS. 4B and 4D), wherein the linkage 114 is so fitted adjacent the trigger bar that the second protrusion 114D is positioned adjacent a top edge of the trigger bar 104. The linkage 114 further comprises a third protrusion 114C extending inward toward the trigger 102, in an assembled configuration, wherein the third protrusion 114C abuts the first protrusion 102E for displacing the linkage 114 in a downward direction when a forward force is applied on the trigger 102, thereby causing the second protrusion 114D to exert a downward acting force adjacent the front end 104A of the trigger bar 104. The working of the first protrusion 102E, the second protrusion 114D, and the third protrusion 114C when the trigger 102 is pulled forward is described in more elaboration in the subsequent sections of the present disclosure.

Figure 2A:
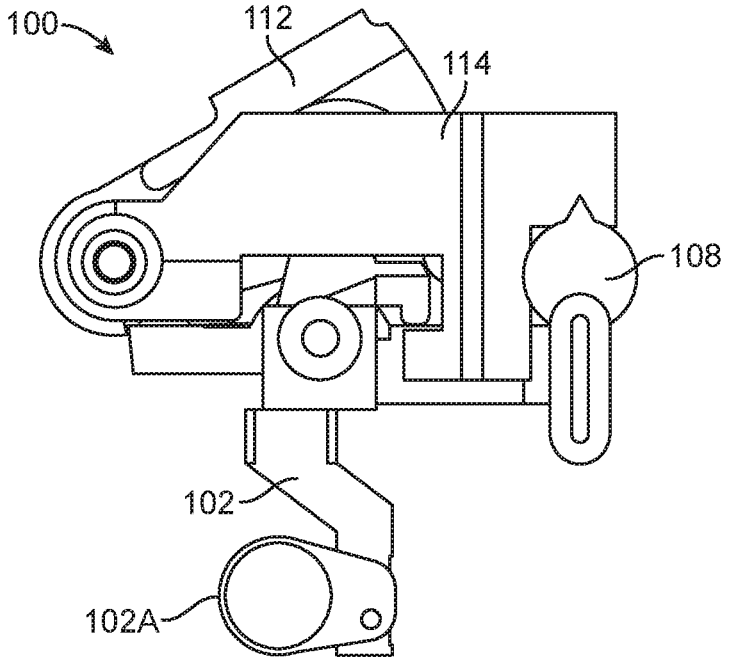
FIG. 2A and FIG. 2B shows side views of trigger assembly, according to an embodiment of the present disclosure.
Figure 2B:
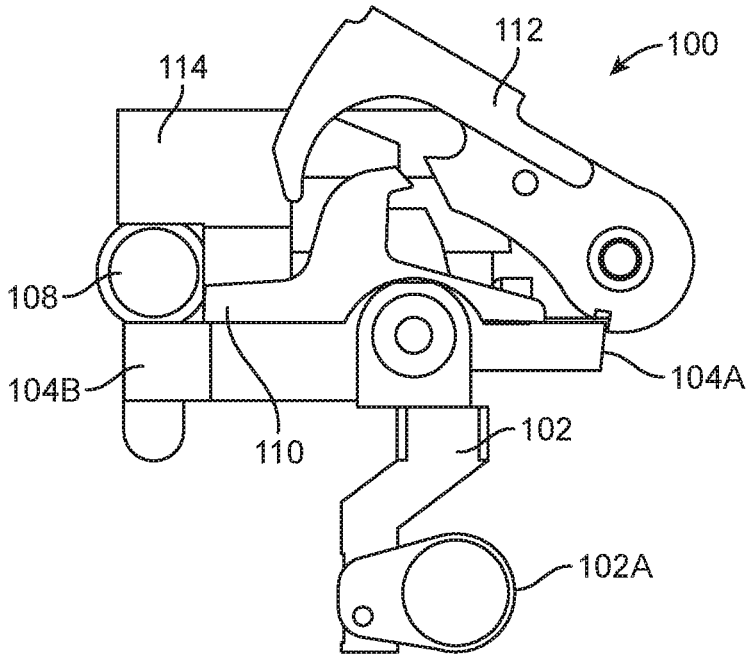

Referring to FIG. 2A and FIG. 2B, side views of trigger assembly 100, according to an embodiment of the present disclosure, are illustrated. The selector switch 108, as seen in FIG. 2A, is in a position that facilitates the unidirectional operation of the trigger assembly 100. More specifically, in an operative horizontal position, which is basically the default or the first operative configuration of the selector switch 108, the selector switch 108 disallows the movement of the trigger bar 104. The position of the selector switch 108 is rotated clockwise substantially orthogonally to put the selector switch 108 in a second operative configuration, as illustrated in FIG. 2A. The operation of the trigger assembly 100 in the second operative configuration is hereinafter described.

Figure 3A:
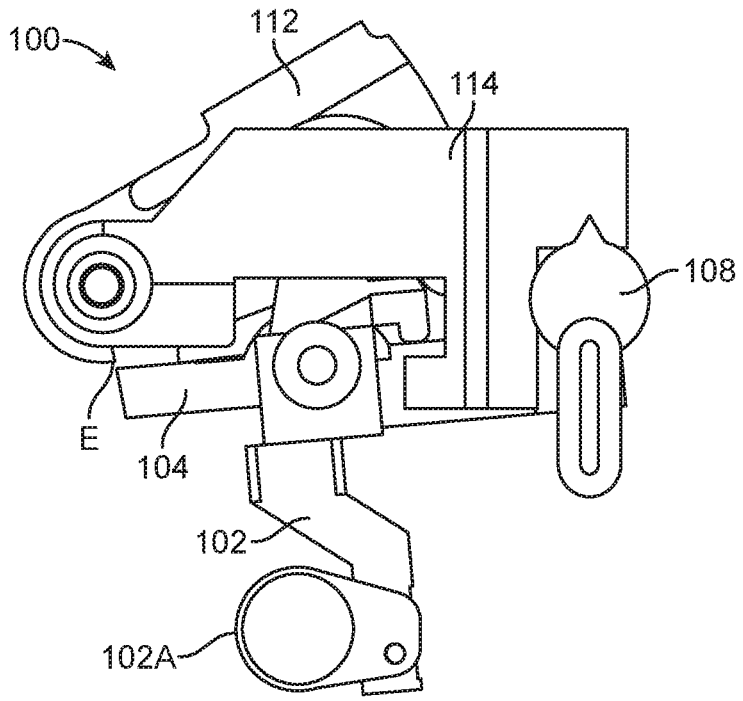
FIG. 3A thru FIG. 3F show side views of trigger assembly in different stages of second operative configuration thereof, according to an embodiment of the present disclosure.
Figure 3B:
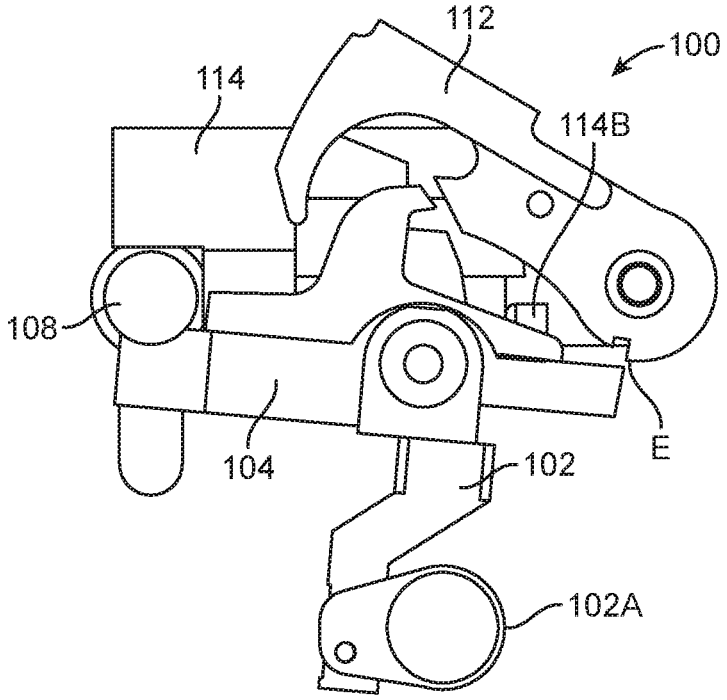

Referring to FIG. 3A thru FIG. 3F, side views of trigger assembly 100 in different stages of second operative configuration thereof, according to an embodiment of the present disclosure, are illustrated. In the second operative configuration, the operation of the trigger assembly is similar to the operation of the conventional trigger assemblies. In the second operative configuration, the selector switch 108 is rotated in a clockwise direction substantially orthogonal relative to the position of the selector switch 108 in the first operative configuration. This rotation of the selector switch 108 facilitates the movement of the trigger bar 104, as is the case with the conventional trigger assemblies. More specifically, when the trigger 102 is pulled rearward, the front end 104A of the trigger bar 104 is displaced in an operative downward direction, thereby releasing a sear engagement E between the trigger bar 104 and the hammer 112, thus releasing the hammer 112, as seen in FIG. 3A and FIG. 3B.

Figure 3C:
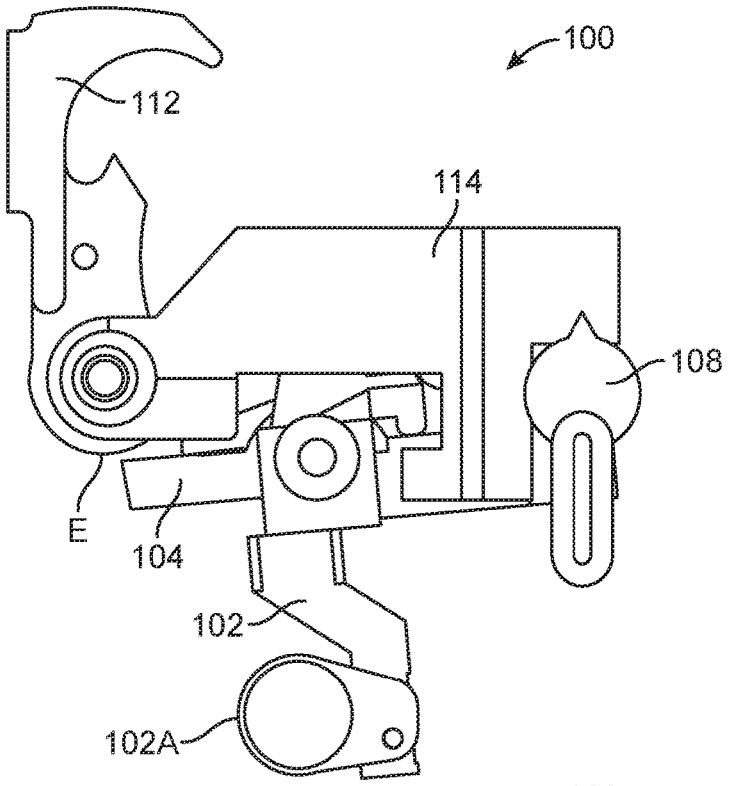
Figure 3D:
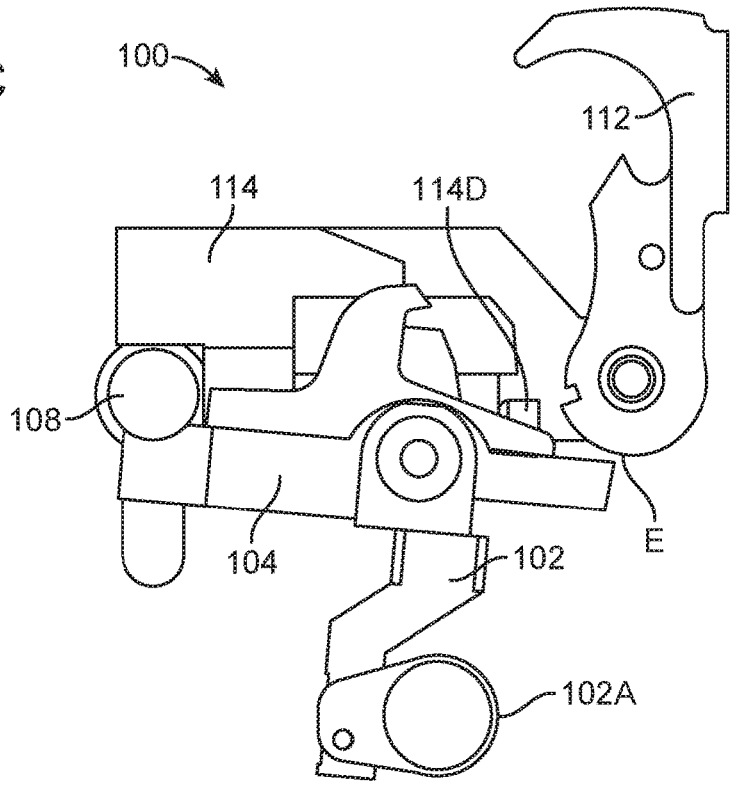

As illustrated in FIG. 3C and FIG. 3D, when the sear engagement E between the hammer 112 and the trigger bar 104 is released, the hammer 112 is released and moves pivotally in a forward direction under the influence of a biasing member, e.g., a spring (not illustrated in figures). In this position, the hammer 112 performs its function of hammering onto the firing pin to fire a round.

Figure 3E:
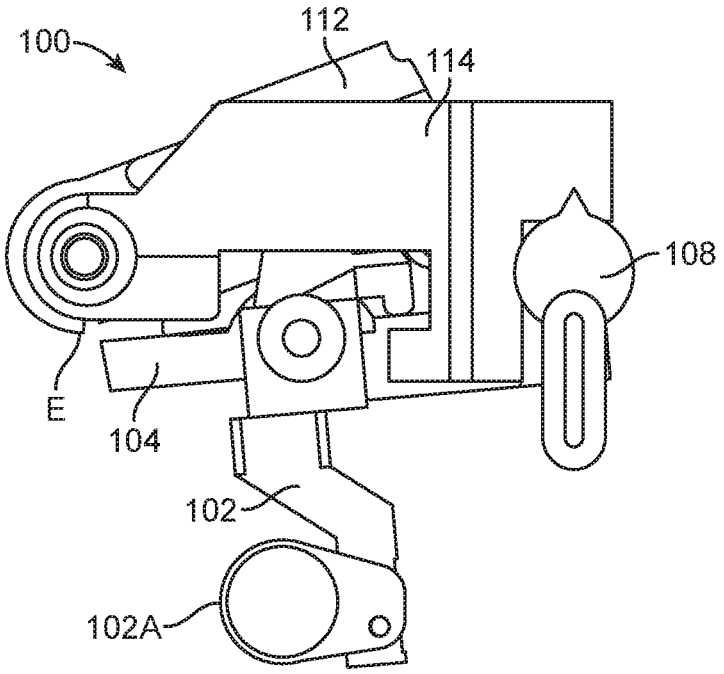
Figure 3F:
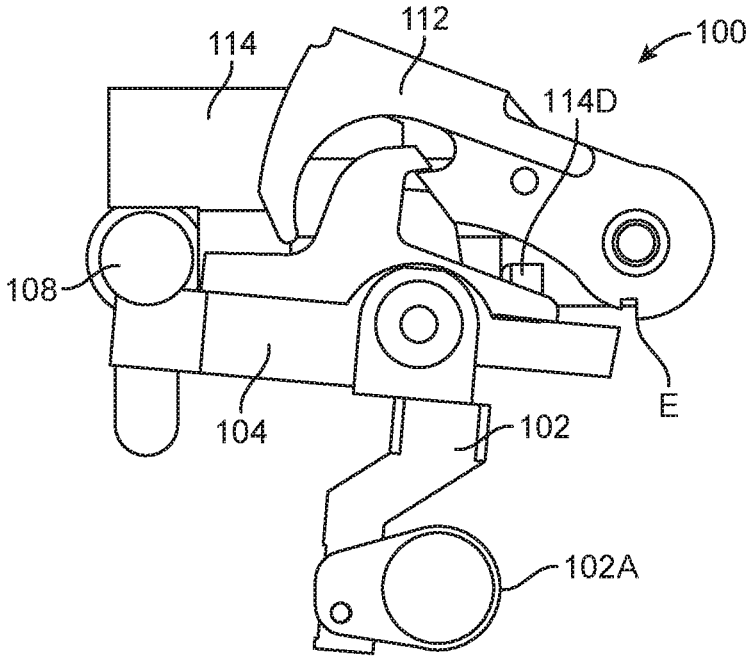

As illustrated in FIG. 3E and FIG. 3F, subsequent to firing the round, the hammer 112 is propelled in a rearward direction to engage with the disconnector 110, thereby holding the hammer 112 until the trigger 102 is released by the user. After the trigger 102 is released, the trigger assembly 100 returns to its original state that is illustrated in FIG. 2A and FIG. 2B, wherein the sear engagement E between the hammer 112 and the trigger bar 104 is resumed.

Referring to FIG. 4A thru FIG. 4D, side views of trigger assembly 100 in different stages of third operative configuration thereof, according to an embodiment of the present disclosure, are illustrated. In a third operative configuration, the selector switch 108 is rotated in a clockwise direction substantially orthogonal relative to the position of the selector switch 108 in the second operative configuration. In the third operative configuration, the trigger assembly 100 is configured for bi-directional operation. Bi-directional operation herein refers to the feature of allowing the user of the firearm to pull the trigger either forward or rearward for firing a round. The operation of the trigger assembly 100, in the third operative configuration when the trigger 102 is pulled rearward is similar to the operation of the trigger assembly 100 in the second operative configuration, as discussed above. As such, the same is not repeated for the sake of brevity of the present disclosure.

As illustrated in FIG. 4A and FIG. 4B, the trigger 102 is pulled forward causing the front end of the trigger bar 104 to be displaced in an operative downward direction. This releases the sear engagement E between the trigger bar 104 and the hammer 112, thus releasing the hammer 112. More specifically, when the trigger 102 is pulled forward, the first protrusion 102E of the trigger 102 engages with the third protrusion 114C of the linkage 114. The engagement of the first protrusion 102E with the third protrusion 114C causes the linkage 114 to be displaced in an operative downward direction. The displacement of the linkage 114 in the operative downward direction facilitates the abutment of the second protrusion 114D of the linkage 114 at a location adjacent the front end 104A of the trigger bar 104 thus releasing the sear engagement E between the trigger bar 104 and the hammer 112. When the sear engagement E between the hammer 112 and the trigger bar 104 is released, the hammer 112 is propelled forward for hammering onto a bullet under the influence of a biasing member (not illustrated in figures).

After the round is fired, the hammer 112 is propelled rearwards, as illustrated in FIG. 4C and FIG. 4D, and engages with the disconnector 110 until the trigger 102 is released and the sear engagement is resumed between the hammer 112 and the trigger 102.

Although the features, functions, components, and parts have been described herein in accordance with the teachings of the present disclosure, the scope of coverage of this patent is not limited thereto. On the contrary, this patent covers all embodiments of the teachings of the disclosure that fairly fall within the scope of permissible equivalents.

Many modifications and other implementations of the disclosure set forth herein will be apparent having the benefit of the teachings presented in the foregoing descriptions and the associated drawings. Therefore, it is to be understood that the disclosure is not to be limited to the specific implementations disclosed and that modifications and other implementations are intended to be included within the scope of the appended claims. Although specific terms are employed herein, they are used in a generic and descriptive sense only and not for purposes of limitation.

What is claimed is:

1. A bi-directional trigger assembly for a firearm:

a trigger having a first protrusion;

a trigger bar coupled to the trigger, the trigger bar having a front end and a rear end, wherein the trigger bar defines a slot;

a selector switch positioned adjacent the rear end of the trigger bar, wherein the selector switch is operably coupled to the trigger bar for allowing or disallowing a movement of the trigger bar;

a disconnector accommodated within the slot;

a hammer provided adjacent the front end of the trigger bar, wherein the hammer is configured for operable coupling to the trigger bar and the disconnector; and a linkage configured for fitment adjacent the trigger bar within the fire arm, wherein the linkage includes:

a second protrusion, wherein the linkage is so fitted adjacent the trigger bar that the second protrusion is positioned adjacent a top edge of the trigger bar; and a third protrusion extending inward toward the trigger, in an assembled configuration, wherein the third protrusion abuts the first protrusion for displacing the linkage downward when a forward force is applied on the trigger, thereby causing the second protrusion to exert a downward acting force adjacent the front end of the trigger bar.

2. The bi-directional trigger assembly according to claim 1, wherein in a first operative configuration, the selector switch disallows a movement of the trigger bar, thereby rendering the firearm inoperative.

3. The bi-directional trigger assembly according to claim 1, wherein in a second operative configuration, the selector switch is rotated in a clockwise direction substantially orthogonal relative to the position of the selector switch in the first operative configuration, wherein in the second operative configuration, the trigger assembly is configured to function unidirectionally by facilitating rearward movement of the trigger.

4. The bi-directional trigger assembly according to claim 3, wherein in the second operative configuration:

the trigger is pulled rearward causing the front end of the trigger bar to be displaced in an operative downward direction, thereby releasing a sear engagement between the trigger bar and the hammer, thus releasing the hammer; and subsequent to firing a round, the hammer is propelled in a rearward direction to engage with the disconnector, thereby holding the hammer until the trigger is released and the sear engagement between the hammer and the trigger bar is resumed.

5. The bi-directional trigger assembly according to claim 1, wherein in a third operative configuration, the selector switch is rotated in a clockwise direction substantially orthogonal relative to the position of the selector switch in the second operative configuration, wherein in the third operative configuration, the trigger assembly is configured for bi-directional operation.

6. The bi-directional assembly according to claim 5, wherein in the third operative configuration:

the trigger is pulled rearward causing the front end of the trigger bar to be displaced in an operative downward direction, thereby releasing a sear engagement between the trigger bar and the hammer, thus releasing the hammer; and subsequent to firing a round, the hammer is propelled in a rearward direction to engage with the disconnector, thereby holding the hammer until the trigger is released and the sear engagement between the hammer and the trigger bar is resumed.

7. The bi-directional assembly according to claim 5, wherein in the third operative configuration:

the trigger is pulled forward causing the front end of the trigger bar to be displaced in an operative downward direction, thereby releasing a sear engagement between the trigger bar and the hammer, thus releasing the hammer, wherein:

when the trigger is pulled forward, the first protrusion of the trigger engages with the third protrusion of the linkage, thereby causing the linkage to be displaced in an operative downward direction, wherein the displacement of the linkage in the operative downward direction facilitates the abutment of the second protrusion of the linkage at a location adjacent the front end of the trigger bar causing thus releasing the sear engagement between the trigger bar and the hammer.

8. The bi-directional assembly according to claim 1, further comprising a finger loop coupled to the trigger for facilitating pulling of the trigger in the forward direction as well as in the rearward direction.

* * * * *